US009217326B2

(12) United States Patent
Coulston

(10) Patent No.: US 9,217,326 B2
(45) Date of Patent: Dec. 22, 2015

(54) SYSTEMS AND METHODS FOR IMPLEMENTING DIFFERENT MODES OF COMMUNICATION ON A COMMUNICATION LINE BETWEEN SURFACE AND DOWNHOLE EQUIPMENT

(75) Inventor: Stephen J. Coulston, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1132 days.

(21) Appl. No.: 13/198,347

(22) Filed: Aug. 4, 2011

(65) Prior Publication Data

US 2013/0033383 A1 Feb. 7, 2013

(51) Int. Cl.
*G01V 3/00* (2006.01)
*E21B 47/12* (2012.01)

(52) U.S. Cl.
CPC ..... *E21B 47/12* (2013.01)

(58) Field of Classification Search
CPC E21B 47/12; G08C 2200/00; G08C 2201/00; G08C 15/00
USPC ..... 340/854.9, 853.1–854.5
See application file for complete search history.

(56) References Cited

U.S. PATENT DOCUMENTS 4,326,287 A * 4/1982 Abramson ..... H04L 5/1476 370/276
4,412,207 A * 10/1983 Sinclair ..... G01V 3/38 341/139
4,532,931 A * 8/1985 Mills ..... A61N 1/056 128/902
4,720,681 A * 1/1988 Sinclair ..... G01V 3/38 324/233
5,226,333 A * 7/1993 Hess ..... E21B 47/1005 166/241.5
5,412,568 A 5/1995 Schultz
6,369,718 B1 * 4/2002 Mathieu ..... E21B 47/12 333/100
6,459,363 B1 * 10/2002 Walker ..... H02J 13/0003 340/12.37
6,657,551 B2 12/2003 Huckaba
7,042,367 B2 5/2006 Gardner
7,868,781 B2 * 1/2011 Misumi ..... G01D 5/24452 340/870.01
7,902,695 B2 * 3/2011 London ..... H03K 3/53 307/106
8,496,065 B2 * 7/2013 McCarter ..... E21B 31/007 166/242.6
8,547,246 B2 * 10/2013 Menezes ..... G01V 11/002 340/854.3
8,629,782 B2 * 1/2014 Li ..... E21B 47/12 340/853.1
8,645,571 B2 * 2/2014 Downton ..... E21B 47/12 340/853.3
2004/0090230 A1 * 5/2004 Appel ..... G01V 3/32 324/307

(Continued)

FOREIGN PATENT DOCUMENTS

WO WO-2011-019340 2/2011

*Primary Examiner* — Brian Zimmerman
*Assistant Examiner* — An T Nguyen
(74) *Attorney, Agent, or Firm* — Law Offices of Mark L. Berrier

(57) ABSTRACT

Systems and methods for enabling communication using two different alternative protocols on a single communication line between remote tools and control equipment used in well operations. In one embodiment, a system includes control equipment, remote tools and a communication line coupled between the control equipment and the remote tools. Each remote tool detects mode control signals on the communication line and operates alternately in either a first mode or a second mode in response to detecting corresponding mode control signals. The first mode enables two-way communication of data on the communication line according to a first communications protocol. The second mode enables one-way communication of data on the communication line from the remote equipment to the control equipment according to a second protocol. The second protocol is different from the first protocol, and may be incompatible with the first protocol.

16 Claims, 4 Drawing Sheets

(56) References Cited

U.S. PATENT DOCUMENTS

2005/0104743 A1* 5/2005 Ripolone ..... G01V 11/002 340/855.1
2005/0275527 A1* 12/2005 Kates ..... G08B 25/009 340/539.22
2006/0202856 A1* 9/2006 Osterloh ..... G01D 4/006 340/870.02
2007/0061039 A1* 3/2007 Misumi ..... G01D 5/24452 700/245
2008/0030365 A1* 2/2008 Fripp ..... E21B 47/16 340/853.1
2008/0253228 A1* 10/2008 Camwell ..... E21B 47/12 367/82
2009/0145603 A1 6/2009 Coronado
2010/0084191 A1 4/2010 Chapman
2010/0286800 A1* 11/2010 Lerche ..... E21B 43/116 700/90
2010/0295702 A1* 11/2010 Zhao ..... G01V 11/002 340/855.4
2010/0305644 A1* 12/2010 Spinelli ..... A61N 1/371 607/17
2011/0140907 A1* 6/2011 Louden ..... G01V 11/002 340/854.3
2011/0187555 A1* 8/2011 Khromov ..... G01V 3/00 340/853.2
2011/0246154 A1* 10/2011 Koutsabeloulis .... G01V 99/005 703/6
2011/0253373 A1* 10/2011 Kumar ..... E21B 21/00 166/306
2012/0026003 A1* 2/2012 Layton ..... G01V 11/002 340/854.9
2013/0033383 A1* 2/2013 Coulston ..... E21B 47/12 340/854.9

* cited by examiner (mode 1)

(mode 2)

SYSTEMS AND METHODS FOR IMPLEMENTING DIFFERENT MODES OF COMMUNICATION ON A COMMUNICATION LINE BETWEEN SURFACE AND DOWNHOLE EQUIPMENT

BACKGROUND

1. Field of the Invention

The invention relates generally to production of oil, gas, water, etc., and more particularly to systems and methods for communicating between remote tools and control equipment used in well operations using separate and distinct communication protocols on a single communication line.

2. Related Art

The efficient operation of wells to produce oil and gas involves the collection and processing of large amounts of data and the adjustment of production equipment installed in the wells. Many different tools may be used downhole within the wells to collect information and regulate well operations. For instance, gauges may be used to sense well conditions and to provide corresponding data to control equipment at the surface of the well. This information may be processed and used to control other downhole tools.

Communications between the surface equipment and the different downhole tools may require different protocols. In the case of gauges and other data collection tools, the communications may consist of one-way, high-data-rate transmissions from the downhole tools to the surface equipment. In the case of tools that regulate the operation of the well, it may be necessary to support two-way communications that may occur infrequently and involve minimal amounts of data, but require a high degree of reliability.

Conventionally, a well system will implement only one of these types of communications. If two different communication protocols are implemented, they would require two different cables on which the different protocols are implemented. The implementation of different communication protocols using separate cables is costly and often impractical. Consequently, it would be desirable to provide a means to implement multiple, distinct, possibly even incompatible communication protocols without the cost of separate communication lines and corresponding interfaces.

SUMMARY OF THE INVENTION

The present systems and methods enable communication using two different alternative protocols on a single communication line between remote (e.g., downhole) tools and control (e.g., surface) equipment used in well operations. The remote tools detect mode control signals transmitted by the control equipment and initiate the corresponding communication modes with their respective protocols in response to detecting the mode control signals.

One embodiment comprises a system that includes the control equipment, one or more remote tools and a communication line coupled between the control equipment and the remote tools. Each of the remote tools includes a signal detector configured to detect mode control signals on the communication line. Each of the remote tools operates alternately in either a first mode or a second mode in response to detecting corresponding mode control signals. The first mode enables two-way communication of data on the communication line according to a first communications protocol. The second mode enables one-way communication of data on the communication line from the remote equipment to the control equipment according to a second protocol. The second protocol is different from the first protocol, and may be incompatible with the first protocol.

In one embodiment, the first mode is initiated in response to detecting a bipolar mode control signal, while the second mode is initiated in response to detecting a unipolar mode control signal such as a voltage pulse. In this embodiment, when the remote tools operate in the first mode, the remote tools acknowledge transmissions received from the control equipment. The communication line may be a dedicated communication line having two conductors, where the unipolar mode control signal comprises identical sync pulses on each of the two conductors, and the bipolar mode control signal comprises signals of opposite polarities on the two conductors. The mode control signal and/or other transmissions in the two-way communication mode may identify an address of a tool to which the transmissions are targeted.

Another embodiment comprises a method implemented in a system having a control transceiver coupled by a communications cable to one or more remote tools. In this method, a first mode control signal is transmitted from the control transceiver to the remote tools. In response to the first mode control signal, the tools initiate a first communication mode that employs a first communication protocol. The method also includes transmitting a second mode control signal from the control transceiver to the remote tools. In response to the second mode control signal, the tools initiate a second communication mode that employs a second communication protocol. The two communication protocols are different and may even be incompatible (i.e., cannot be used simultaneously).

Yet another embodiment comprises a remote tool that has a signal detector configured to detect mode control signals received from external equipment. The remote tool operates alternately in one of two different modes in response to detecting one of the mode control signals. In a first mode, the remote tool enables two-way communication of information between the remote tool and the external equipment according to a first communications protocol. In a second mode, the remote tool is configured to enable one-way communication of data from the remote tool to the external equipment according to a second protocol which is different from the first protocol.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
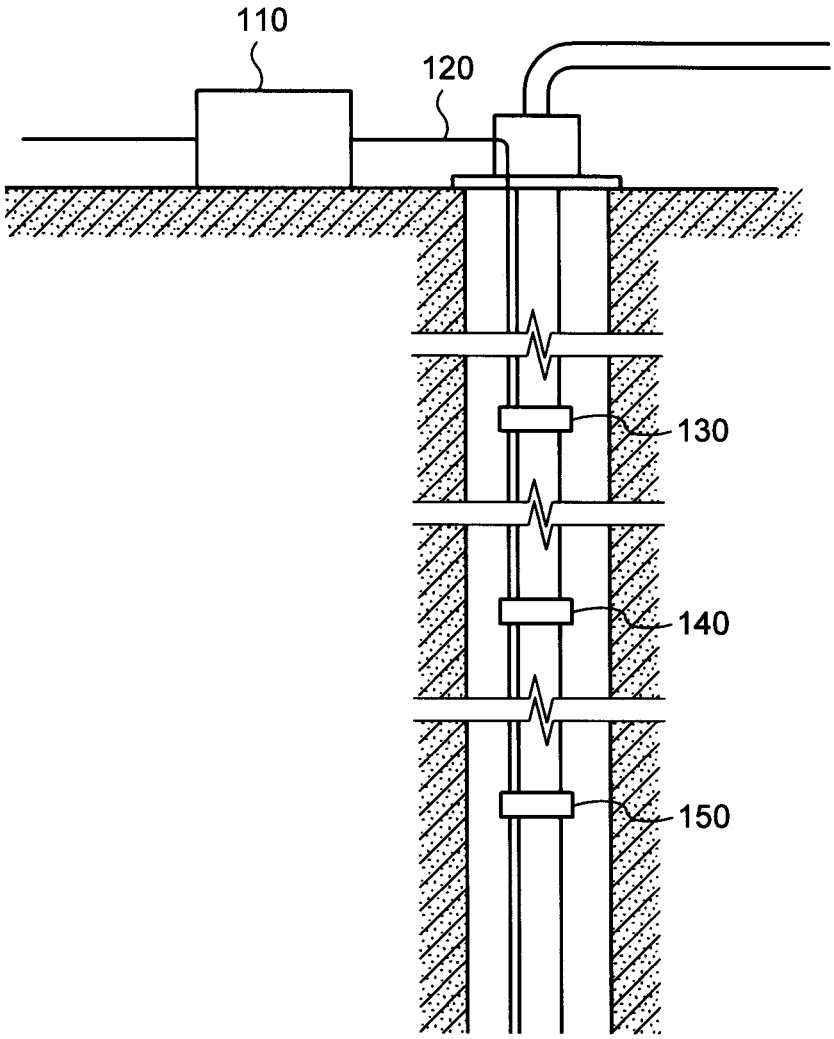
FIG. 1 is a functional block diagram illustrating a communication system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

Generally speaking, the present systems and methods for communicating between remote (e.g., downhole) tools and control (e.g., surface) equipment used in wellbore operations, where two separate and distinct communication protocols are implemented and alternately used on a single communications line coupled between the remote tools and control equipment.

One embodiment is implemented in an oil production system installed in a well. The system includes multiple downhole tools that are positioned in the wellbore, each of which is coupled to a single dedicated communications line. The downhole tools may include gauges that serve to sense well conditions and transmit sensor data to the surface, as well as controls such as valves and packers that affect operation of the well. The communications line is also coupled to equipment positioned at the surface of the well. The surface equipment serves to process data received from the downhole tools, as well as to transmit control information to the downhole tools.

The communications line has two conductors (e.g., a twisted pair) that carry electrical signals between the downhole tools and the surface equipment. The communications line may also carry power to the downhole tools. These conductors can be used to carry unipolar signals in which both conductors carry identical signals, or bipolar signals in which the two conductors carry different signals. The surface equipment can initiate a first communications mode by transmitting a bipolar mode control signal to the downhole tools. A communication protocol used in this mode enables two-way communications between the surface equipment and downhole tools. These communications have a low data rate, but implement error checking and acknowledgments to provide high reliability. The surface equipment can initiate a second communications mode by transmitting a unipolar mode control signal to the downhole tools. A communication protocol used in this mode enables one-way communications from the downhole tools to the surface equipment at a high data rate.

Referring to FIG. 1, a functional block diagram illustrating a communication system in accordance with one embodiment is shown. In this embodiment, surface equipment 110 is coupled to a communication line 120. Communication line 120 extends into a well and is coupled to one or more downhole tools (e.g., 130, 140, 150). The downhole tools may include various types of sensors, packers, valves, or other tools. Data transmitted by the surface equipment or any of the downhole tools coupled to the communication line is seen by all of these devices.

In one embodiment, the downhole tools in the system include both gauges and control devices. The gauges are designed to monitor well parameters (e.g., pressure, temperature, vibration, etc.) and to transmit data corresponding to these parameters to the surface equipment. Consequently, they normally require only one-way communications (from the tools to the surface equipment). Gauges may also be utilize two-way communications for such purposes as changing their configurations, communicating diagnostic information, or targeting specific gauges. Typically, the one-way communications carry a large amount of data that is continuously updated. Error checking in this data can be minimal. The control devices, on the other hand, require two-way communications. While communications with these devices are typically infrequent, and the amount of data communicated is minimal, the reliable communication of the data is important. These communications therefore implement error checking, and the transmissions in each direction are acknowledged by the receiving devices. These features may also be implemented in two-way communications involving gauges.

It should be noted that the system may include downhole tools that are only capable of operating in one communication mode. These tools will continue to operate in this single mode and will communicate in response to the corresponding mode control signal, while ignoring the mode control signal that initiates the other communication mode.

Figure 2:
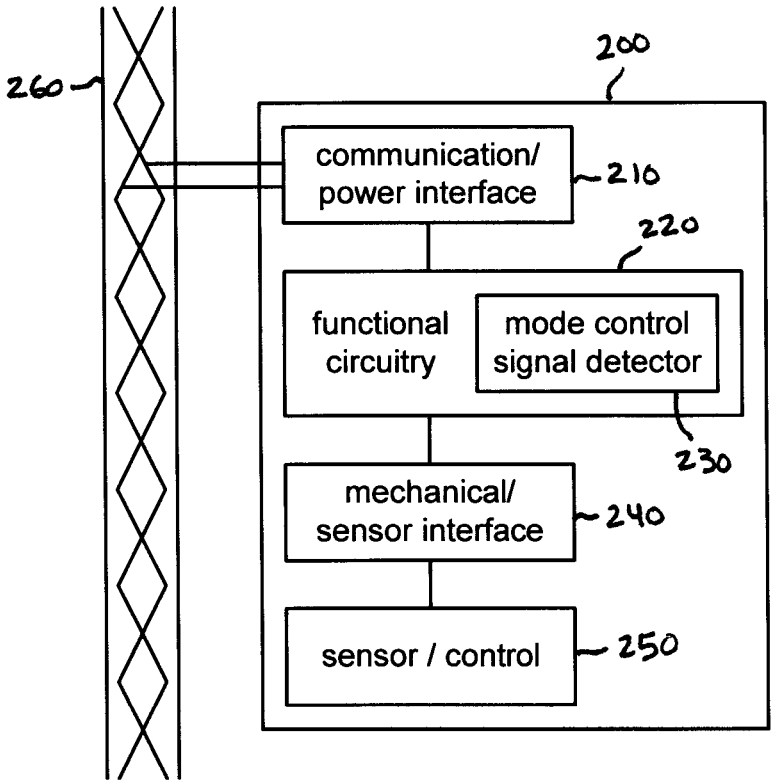
FIG. 2 is a functional block diagram illustrating the structure of a downhole tool in accordance with one embodiment.

Referring to FIG. 2, a functional block diagram illustrating the structure of a downhole tool in accordance with one embodiment is shown. This figure represents a generic structure that is applicable to both gauges and control devices. In this embodiment, tool 200 includes communications/power interface 210, functional circuitry 220, mode control signal detector 230, mechanical/sensor interface 240, and sensor/control 250. Communications/power interface 210 couples tool 200 to dedicated communications line 260. Communications/power interface 210 receives information transmitted by surface equipment that is also coupled to the communications line, and also transmits data via the communications line to the surface equipment. Information received via communications line 260 is provided to functional circuitry 220, which processes the information. Functional circuitry 220 includes mode control signal detector 230. When mode control signals are received by tool 200, mode control signal detector 230 identifies these signals and, if necessary, causes functional circuitry 220 to change to the indicated mode. Functional circuitry 220 is coupled to mechanical/sensor interface 240 to enable communication with the sensor/control components of the tool, such as sensors, valves, packers, and the like. In the case of sensors, the communication may simply consist of receiving sensor data. In the case of control systems, the communication may include providing control information to the mechanical system to control its operation, as well as receiving data and control feedback from the mechanical system.

Downhole tool 200 is configured to operate alternately in one of two modes. The first one of these modes uses a protocol that is designed to provide reliable, two-way communication between the surface equipment and the tool. This mode is used for control communications that do not involve the transmission of large amounts of data, but should be made with a high degree of reliability. This mode therefore employs error checking and acknowledgment of received communications (in both directions). The second of the communication modes uses a different protocol than the first. The second protocol is designed to provide one-way communications from the downhole tool to the surface equipment at a high data rate.

In some embodiments, although communications line 260 is capable of carrying data using either of the two protocols, they may be vastly different. In some cases, the protocols may be incompatible, so that they cannot be employed simultaneously on the same line. In order to allow the two different protocols to be implemented on the same line between the downhole tool and the surface equipment, a mechanism must be provided to switch between the two protocols. In this embodiment, the surface equipment is configured to switch between the modes by transmitting a mode control signal on the data line. A bipolar signal is transmitted to initiate use of the first, two-way mode, and a unipolar signal is transmitted to initiate use of the second, one-way mode. In some alternative embodiments, the protocols may be sufficiently compatible to allow them to be implemented in combination.

As noted above, the data line that couples the surface equipment to the downhole tool(s) has two conductors on which signals are transmitted. (The data line may also have a conductor that carries power to the downhole tools.) For the purposes of this disclosure, "unipolar" refers to a signal that is carried identically (noise notwithstanding) on both conductors of the data line. A "bipolar" signal, on the other hand, is one in which the signals carried by the two conductors need not be the same. Bipolar signals may have identical magnitudes with opposite polarities, or they may have unequal magnitudes.

Figure 3:
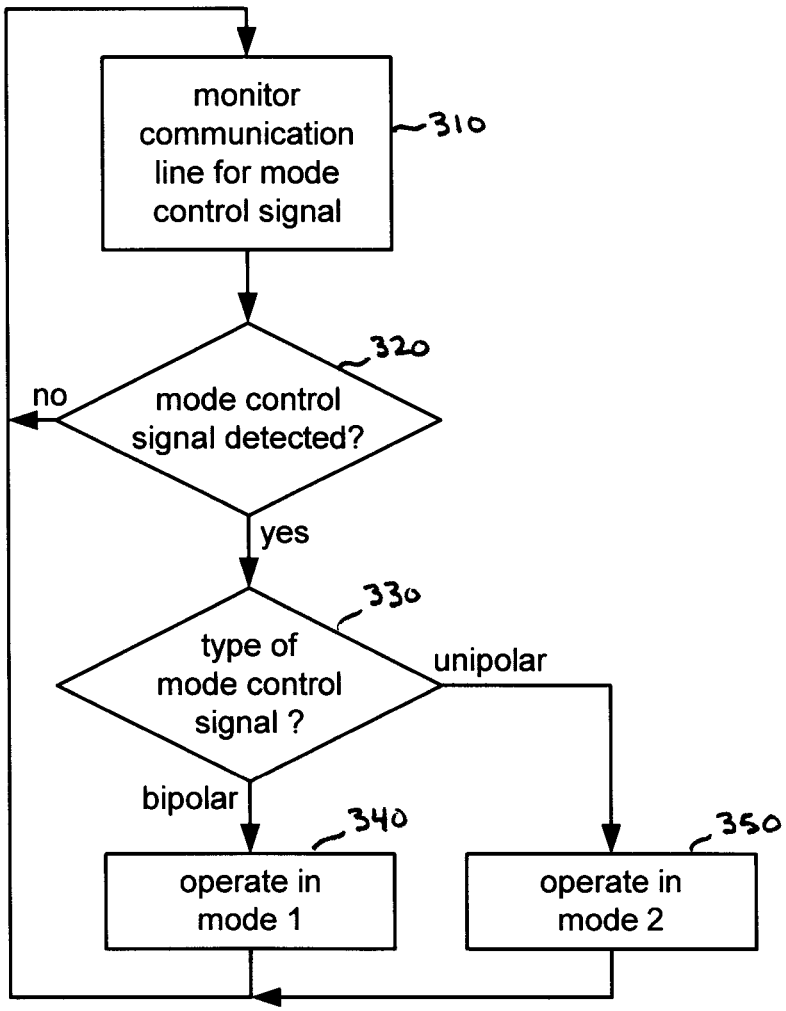
FIG. 3 is a flow diagram illustrating a method for switching between different modes on the same data line in accordance with one embodiment.

Referring to FIG. 3, a flow diagram illustrating one method for switching between different modes (and corresponding protocols) on the same data line is shown. In this method, the mode control signal detector monitors the data line for mode control signals (310). If no mode control signal is detected (320), the tool simply continues to operate in the current communication mode (which may be either the first or second mode) and continues to monitor the data line for mode control signals (310). If a mode control signal is detected (320), the type of the mode control signal is determined (330). If the signal is a bipolar mode control signal, the tool begins operating in the first, two-way communications mode (340). If the signal is a unipolar mode control signal, the tool begins operating in the second, one-way communications mode (350).

In the embodiment of FIG. 3, the downhole tools continue to communicate in a given mode as long as they do not receive a mode control signal that initiates the other mode. For instance, the tools may repeatedly communicate data in their respective time slots until the communication mode is changed. In an alternative embodiment, each tool may communicate data once in response to a mode control signal, and then wait for another mode control signal (either the same as, or different from, the previous mode control signal) before transmitting any more data.

It should be noted that, in one embodiment, the system may include multiple downhole tools that are coupled to the same data line. The surface equipment may need to communicate with any one of these tools to control or configure the tool. Consequently the bipolar mode control signal may include addressing information that indicates the specific tool with which the surface equipment is attempting to communicate. If a particular downhole tool detects a bipolar mode control signal but determines that it is not the tool that is the target of the signal, it will disregard the mode control signal and continue to operate in the current communication mode. If the tool determines that it is the target of the bipolar mode control signal (i.e., it corresponds to the address associated with the mode control signal), it will begin operating in the first, two-way communications mode.

Figure 4:
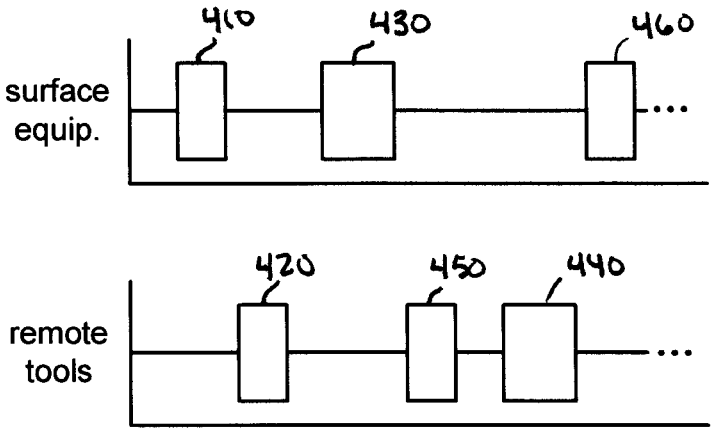
FIG. 4 is a timing diagram illustrating communications using a two-way protocol in one embodiment.

Referring to FIG. 4, a timing diagram illustrating communications using a two-way protocol in one embodiment is shown. In this figure, the signals on the two conductors are depicted with a common 0 level and opposite polarities. It should also be noted that the signals depicted in the figure are merely representative of the signal activity, and do not depict actual data.

As depicted in FIG. 4, a bipolar mode control signal 410 is transmitted over the data line by the surface equipment to initiate the two-way communications mode. Mode control signal 410 may be a simple voltage pulse (having opposite polarities on the two conductors), or it may include addressing information to identify a particular target for communications from the surface equipment. Addressing information may alternatively be provided in the transmissions of control/configuration information to the targeted tools. Whether or not bipolar mode control signal 410 includes address information, each of the downhole tools provides an acknowledgment (420) of the mode control signal. The acknowledgments may, for example, be time division multiplexed so that each of the tools transmits its acknowledgment in a designated time slot.

After the bipolar mode control signal has been transmitted and acknowledged, two-way communications between the surface equipment may proceed, with each transmission (e.g., command 430 or response 440) being acknowledged by the receiver of the transmission (e.g., acknowledgments 450, 460) to ensure that it was safely received. This is the case for transmissions in either direction. Transmissions in the two-way communication mode also include error checking to prevent corruption of transmitted data and further enhance the reliability of the communications. While the acknowledgments and error checking may reduce the effective data rate, these two-way communications are primarily for the purpose of controlling and/or configuring the downhole tools, which typically requires minimal amounts of data and is performed relatively infrequently. The two-way communications may be between the surface equipment and a specific one of the downhole tools, or they may be between the surface equipment and all of the downhole tools. In the latter case, the components of the communications corresponding to the different downhole tools may be time division multiplexed or handled in another manner.

Figure 5:
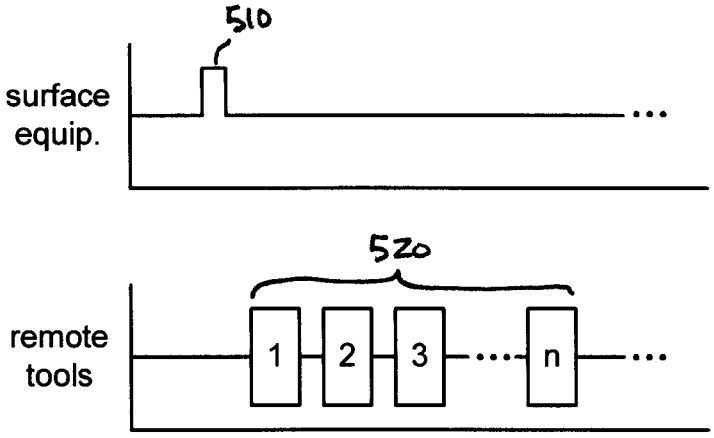
FIG. 5 is a timing diagram illustrating communications using a one-way protocol in one embodiment.

Referring to FIG. 5, a timing diagram illustrating communications using a one-way protocol in one embodiment is shown. In this figure, the signals on the two conductors are overlaid, so that the unipolar signals appear as a single signal, while the opposite polarities of the bipolar signals make both signals apparent. Again, the signals depicted in the figure are merely representative of the signal activity, and do not depict actual data.

As depicted in this figure, a unipolar mode control signal 510 is transmitted over the data line by the surface equipment to initiate the one-way communications mode. In this embodiment, mode control signal 510 is a voltage pulse. This voltage pulse not only serves to indicate that the one-way communication mode is to be initiated, but also serves as a synchronization signal for the downhole tools. Following the transmission of mode control signal 510, each of the downhole tools transmits data to the surface equipment in a designated time slot (see 520). Each of the downhole tools continues to transmit data to the surface equipment according to this time division multiplexing scheme until the surface equipment transmits a mode control signal that initiates a two-way communication mode. It should be noted that, although the figure shows a unipolar mode control signal, the transmissions from the downhole tools may be bipolar.

Alternative embodiments may have a number of variations on the features described above. For example, there may be many different communication protocols that are suitable for communicating data over the line between the surface equipment and downhole tools. Because the mode of communication can be switched between the different protocols, essentially any protocol that could be implemented individually can be implemented in one of the modes. The mode control signals used in a given embodiment may also vary from those described above. For instance, a unipolar signal may be used to initiate a two-way communication mode and a bipolar signal may be used to initiate a one-way communication mode, or entirely different signals may be used to initiate the different communication modes. Still other variations may be made in alternative embodiments that are within the scope of the claims below.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

What is claimed is:

1. A system comprising:

control equipment;

one or more remote tools; and a communication line coupled between the control equipment and the remote tools;

wherein the system is implemented in a well, wherein the control equipment comprises surface equipment positioned at the surface of the well, and wherein the one or more remote tools comprise downhole tools positioned in a wellbore of the well;

wherein each of the remote tools includes a signal detector configured to detect mode control signals on the communication line;

wherein each of the one or more remote tools is configured to alternately operate in either a first mode or a second mode in response to detecting corresponding mode control signals;

wherein the first mode enables two-way communication of data and control information on the communication line between the remote tools and the control equipment according to a first communications protocol;

wherein the second mode enables one-way communication of data on the communication line from the remote tools to the control equipment according to a second protocol which is different from the first protocol; and wherein in response to detecting a bipolar mode control signal, each of the one or more remote tools is configured to operate in the first mode, and wherein in response to detecting a unipolar mode control signal, each of the one or more remote tools is configured to operate in the second mode.

2. The system of claim 1, wherein the second protocol is incompatible with simultaneous use of the first protocol.

3. The system of claim 1, wherein when each of the one or more remote tools operates in the first mode, the remote tool acknowledges received information.

4. The system of claim 1, wherein the unipolar mode control signal comprises a voltage pulse.

5. The system of claim 1, wherein each of the one or more remote tools is configured to receive the mode control signal via a dedicated communication line, wherein the communication line has two conductors, wherein the remote tools are configured to detect the unipolar mode control signal in which each of the two conductors carry one or more identical sync pulses and the bipolar mode control signal in which the two conductors carry one or more sync pulses of opposite polarities.

6. The system of claim 5, wherein at least one of the one or more remote tools is configured to identify a target address contained in the mode control signal and to determine whether the target address is associated with the remote tool.

7. A method implemented in a system having a control transceiver coupled by a communications cable to one or more remote tools, the method comprising:

transmitting a first mode control signal from the control transceiver positioned at the surface of the well to the one or more remote tools positioned in a wellbore of the well, wherein the first mode control signal comprises a bipolar mode control signal;

initiating a first communication mode in response to the first mode control signal, wherein the first communication mode employs a first communication protocol;

transmitting a second mode control signal from the control transceiver to the one or more remote tools, wherein the second mode control signal comprises a unipolar mode control signal;

initiating a second communication mode in response to the second mode control signal, wherein the second communication mode employs a second communication protocol that is different from the first communication protocol.

8. The method of claim 7, wherein the second protocol is incompatible with simultaneous use of the first protocol.

9. The method of claim 7, further comprising, in response to initiating the first mode, acknowledging received communications.

10. The method of claim 7, further comprising, when operating in the first communication mode, identifying in one or more communications a target device to which the communications are directed.

11. An apparatus comprising:

a remote tool; and a signal detector configured to detect mode control signals;

wherein the remote tool comprises a downhole tool positioned in a wellbore of a well;

wherein the downhole tool is configured to receive the mode control signals via a communication line be coupled to surface equipment positioned at the surface of the well;

wherein the remote tool is configured to operate alternately in one of two different modes in response to detecting one of the mode control signals;

wherein in a first mode the remote tool is configured to enable two-way communication of information between the remote tool and the external equipment according to a first communications protocol;

wherein in a second mode the remote tool is configured to enable one-way communication of data from the remote tool to external equipment according to a second protocol which is different from the first protocol; and wherein in response to the signal detector detecting a bipolar mode control signal, the remote tool is configured to operate in the first mode, and wherein in response to the signal detector detecting a unipolar mode control signal, the remote tool is configured to operate in the second mode.

12. The apparatus of claim 11, wherein the second protocol is incompatible with simultaneous use of the first protocol.

13. The apparatus of claim 11, wherein when the remote tool operates in the first mode, the remote tool acknowledges received information.

14. The apparatus of claim 11, wherein the unipolar mode control signal comprises a voltage pulse.

15. The apparatus of claim 11, wherein the signal detector is configured to receive the mode control signal via a dedicated communication line, wherein the communication line has two conductors, wherein the signal detector is configured to detect the unipolar mode control signal in which each of the two conductors carries an identical sync pulse and the bipolar mode control signal in which the two conductors carry sync pulses of opposite polarities.

16. The apparatus of claim 11, wherein the remote tool is configured to identify a target address contained in the mode control signal and to determine whether the target address is associated with the remote tool.

* * * * *